US007693463B2

(12) United States Patent
Yoshida et al.

(10) Patent No.: US 7,693,463 B2
(45) Date of Patent: Apr. 6, 2010

(54) DEVELOPING DEVICE AND IMAGE FORMING APPARATUS

(75) Inventors: Narutaka Yoshida, Toyokawa (JP); Tomohiro Kato, Okazaki (JP); Yuusuke Okuno, Toyokawa (JP); Tomo Kitada, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 546 days.

(21) Appl. No.: 11/785,354

(22) Filed: Apr. 17, 2007

(65) Prior Publication Data

US 2007/0258733 A1 Nov. 8, 2007

(30) Foreign Application Priority Data

Apr. 19, 2006 (JP) ..... 2006-115235

(51) Int. Cl.
*G03G 15/08* (2006.01)

(52) U.S. Cl. ..... 399/258

(58) Field of Classification Search ..... 399/254, 399/255, 258, 272, 281
See application file for complete search history.

(56) References Cited

U.S. PATENT DOCUMENTS 4,967,691 A * 11/1990 Chikama et al. ..... 399/62
5,724,635 A * 3/1998 Nagaoka et al. ..... 399/260
6,978,108 B2 * 12/2005 Sakamaki ..... 399/267
7,110,707 B2 * 9/2006 Nishitani ..... 399/258

FOREIGN PATENT DOCUMENTS

| | | |
|---|---|---|
| JP | 2-116875 | 5/1990 |
| JP | 2-135474 | 5/1990 |
| JP | 2927656 | 5/1999 |
| JP | 2001-147578 | 5/2001 |
| JP | 2005-201921 | 7/2005 |
| JP | 2005-345858 | 12/2005 |

OTHER PUBLICATIONS

Japanese Office Action, mailed Apr. 22, 2008, directed to corresponding Japanese Patent Application No. 2006-115235. 9 pages.

* cited by examiner

*Primary Examiner*—Robert Beatty
(74) *Attorney, Agent, or Firm*—Morrison & Foerster LLP

(57) ABSTRACT

A developing device has a bearing member that can bear a toner, a storing chamber for storing the toner, a waiting chamber disposed below the storing chamber for receiving the bearing member that can be filled with the toner and a buffer chamber positioned between the storing chamber and the waiting chamber for storing the developer material. A first horizontal connecting path connects upper portions of the storing and buffer chambers, and two second connecting paths connect lower portions of the buffer chamber and the waiting chamber. A feed member feeds toner from the storing chamber through the first connecting path into the buffer chamber. A first conveying member in the buffer chamber conveys the toner from one of the connecting paths to the other of the connecting paths, and a second conveying member in the waiting chamber conveys the toner within the waiting chamber in the opposite direction.

20 Claims, 9 Drawing Sheets

10

DEVELOPING DEVICE AND IMAGE FORMING APPARATUS

RELATED APPLICATION

This application is based on Japanese patent application No. 2006-115235, filed Apr. 19, 2006, the entire content of which is hereby incorporated by reference.

FIELD OF THE INVENTION

The present invention relates to a developing device which develops an electrostatic latent image with developing material such as toner and an image forming apparatus which includes the developing device.

BACKGROUND OF THE INVENTION

A conventional developing device used in an image forming apparatus for developing an electrostatic latent image with developing material such as toner has a storing chamber for storing toner, a waiting chamber for storing toner to be used for developing immediately afterwards, a feeder for feeding toner from the storing chamber into the waiting chamber, and a developing roller positioned inside the waiting chamber and in part opposed to an image bearing member or a photosensitive drum. The developing roller rotates and carries a certain amount of toner necessary for development from the waiting chamber. The toner on the developing roller is supplied to the photosensitive drum for the development of the electrostatic latent image into a visualized toner image.

For the developing roller to stably receive the necessary amount of toner from the waiting chamber, the waiting chamber needs to hold a certain amount of toner. In order for the waiting chamber to hold the certain amount of toner, an amount of toner from the storing chamber to the waiting chamber is controlled by the feeder which is driven on the basis of a signal from a sensor detecting the amount of toner stored in the waiting chamber. Additionally, a developing device disclosed in the Japanese Patent No. 2927656 has an opening, allowing excessive toner to flow freely out of the waiting chamber in order to prevent an occurrence of an excessive toner pressure in the waiting chamber which would hamper the stable rotation of the developing roller.

Another important consideration for the image forming apparatus using such developing device is that the developing roller should be arranged horizontally. Otherwise, the amount of toner calculated by the signal from the sensor such as pressure sensor can differ from that actually stored in the waiting chamber. This may result in that an excessive or insufficient amount of toner is transported from the waiting chamber.

SUMMARY OF THE INVENTION

Accordingly, an object of the present invention is to provide a developing device and an image forming apparatus which allow a developer material bearing member to bear a certain amount of toner necessary for developing even when an image forming apparatus is installed inclined.

To achieve the object above, the developing device according to one aspect of the present invention has a bearing member capable of bearing a developer material for developing an electrostatic latent image using the developer material. The developing device further includes a bearing member capable of bearing a developer material thereon; a storing chamber capable of storing the developer material; a waiting chamber disposed below the storing chamber, the waiting chamber receiving the bearing member and being capable of being fully or substantially fully filled with the developer material; a buffer chamber positioned between the storing chamber and the waiting chamber, the buffer chamber being capable of storing the developer material fed from the storing chamber and to be fed into the waiting chamber; a first connecting path extending horizontally and connecting an upper portions of the storing and buffer chambers; two second connecting paths each connecting a lower portion of the buffer chamber and the waiting chamber; a feed member capable of feeding the developer material from the storing chamber through the first connecting path into the buffer chamber; a first conveying member disposed within the buffer chamber, the first conveying member being capable of conveying the developer material within the buffer chamber in a first direction from one of the two connecting paths to the other of the two connecting paths; and a second conveying member disposed within the waiting chamber, the second conveying member being capable of conveying the developer material within the waiting chamber in a second direction from the other of the two connecting paths to the one of the two connecting paths; wherein the first connecting path is provided on an upstream side with respect to the first conveying direction.

According to another aspect of the present invention, the developing device has a bearing member capable of bearing a developer material for developing an electrostatic latent image using the developer material. The developing device further includes a bearing member capable of bearing a developer material thereon; a storing chamber capable of storing the developer material; a waiting chamber disposed below the storing chamber, the waiting chamber receiving the bearing member and being capable of being fully or substantially fully filled with the developer material; a buffer chamber positioned between the storing chamber and the waiting chamber, the buffer chamber being capable of storing the developer material fed from the storing chamber and to be fed into the waiting chamber; a first connecting path extending horizontally and connecting a lower portion of the storing chamber and an upper portion of the buffer chambers; two second connecting paths each connecting a lower portion of the buffer chamber and the waiting chamber; a feed member capable of feeding the developer material from the storing chamber through the first connecting path into the buffer chamber; a first conveying member disposed within the buffer chamber, the first conveying member being capable of conveying the developer material within the buffer chamber in a first direction from one of the two connecting paths to the other of the two connecting paths; a second conveying member disposed within the waiting chamber, the second conveying member being capable of conveying the developer material within the waiting chamber in a second direction from the other of the two connecting paths to the one of the two connecting paths; and a restriction member capable of restricting a feeding of the developer material from the storing chamber into the buffer chamber; wherein the first connecting path is provided on an upstream side with respect to the first conveying direction.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following descriptions of the preferred embodiments are merely exemplary in nature and are in no way intended to limit the invention, its application, or uses.

First Embodiment

Figure 1:
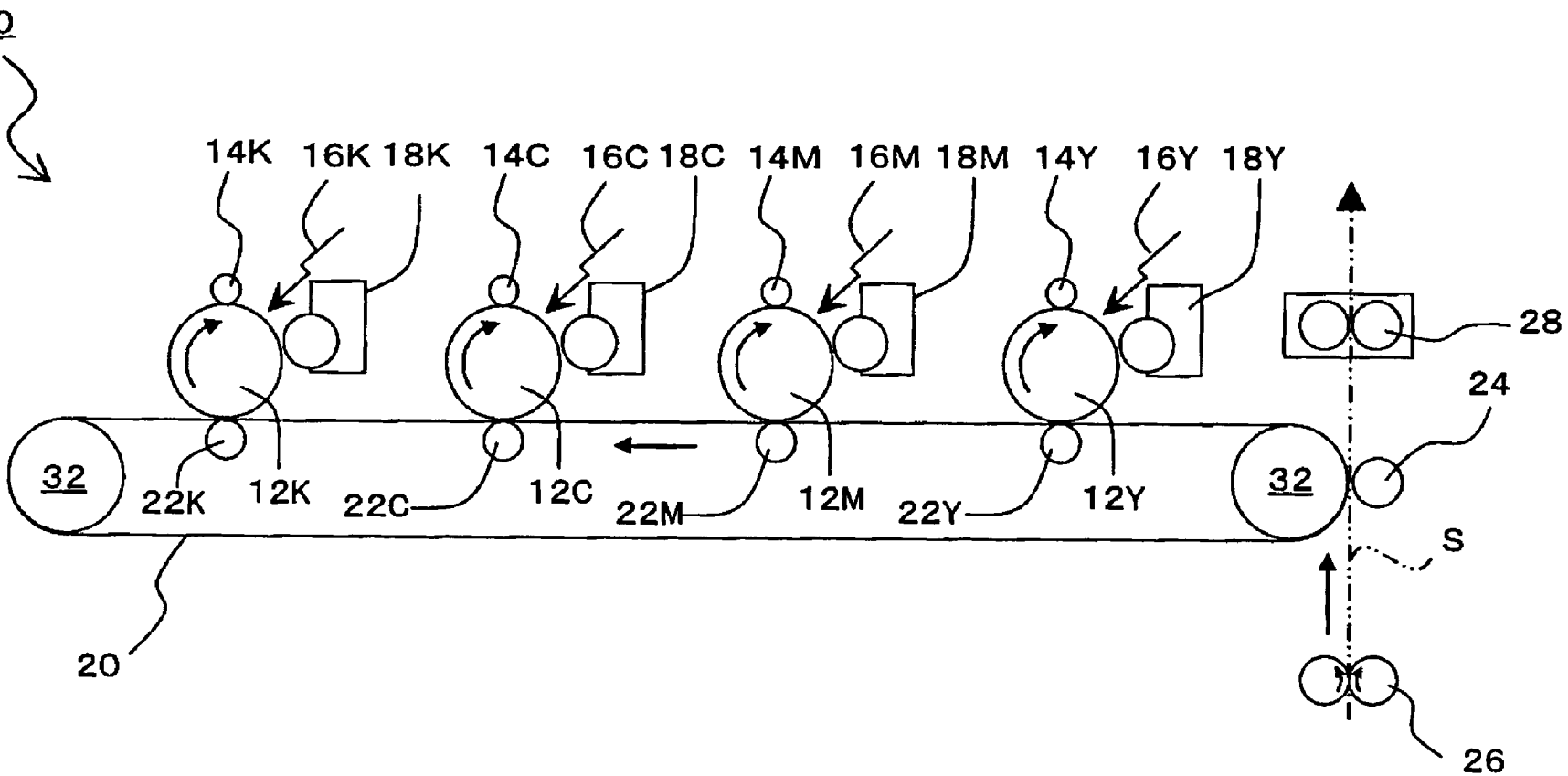
FIG. 1 is a schematic elevational view showing a general structure of an image forming apparatus according to the present invention.

FIG. 1 schematically shows components incorporated in an image forming apparatus, generally indicated by reference numeral 10. The image forming apparatus 10 is a tandem-type image forming apparatus which is capable of forming a full-color image on a recording medium such as sheet by the use of yellow (Y), magenta (M), cyan (C), and black (K) toners.

The structure of the image forming apparatus 10 will be described in combination with its full-color image forming operation. The image forming apparatus has four image bearing members or photosensitive drums 12Y, 12M, 12C, and 12K. Each of the drums 12Y, 12M, 12C, and 12K has an outer peripheral surface covered by a suitable photosensitive layer and is drivingly coupled to a drive source such as a motor (not shown) so as to rotate in the clockwise direction by the driving of the motor. The outer peripheral surfaces of the drums 12Y, 12M, 12C, and 12K are electrically charged by respective charging devices 14Y, 14M, 14C, and 14K and then exposed to lights 16Y, 16M, 16C, and 16K from respective image projecting devices (not shown), so that electrostatic latent images are formed on respective peripheral surfaces of the drums. The electrostatic latent images are developed and visualized with respective toners from the developing devices 18Y, 18M, 18C, and 18K into respective toner images, i.e., yellow, cyan, magenta, and black toner images. The toner images are then transferred onto an intermediate image bearing member or transfer belt 20. The belt 20 is supported by a pair of rollers 32. Either of the rollers 32 is drivingly coupled to a motor (not shown) so that the belt 20 is circulated in the counterclockwise direction. During this circulation of the belt 20, the four toner images are transferred sequentially, with the aids of transfer devices 22Y, 22M, 22C, and 22K, onto the outer periphery of the belt 20 to form a full color image on the belt. The full color image is then transferred with the aid of another transfer device 24 onto the recording medium S being transported by a transport device 26. The recording medium S bearing the full color image is transported into a fixing device 28 where the full color image is fused and fixed on the recording medium. The recording medium S is then transported to a discharge tray or a finishing device such as stacking device (both not shown).

Figure 2:
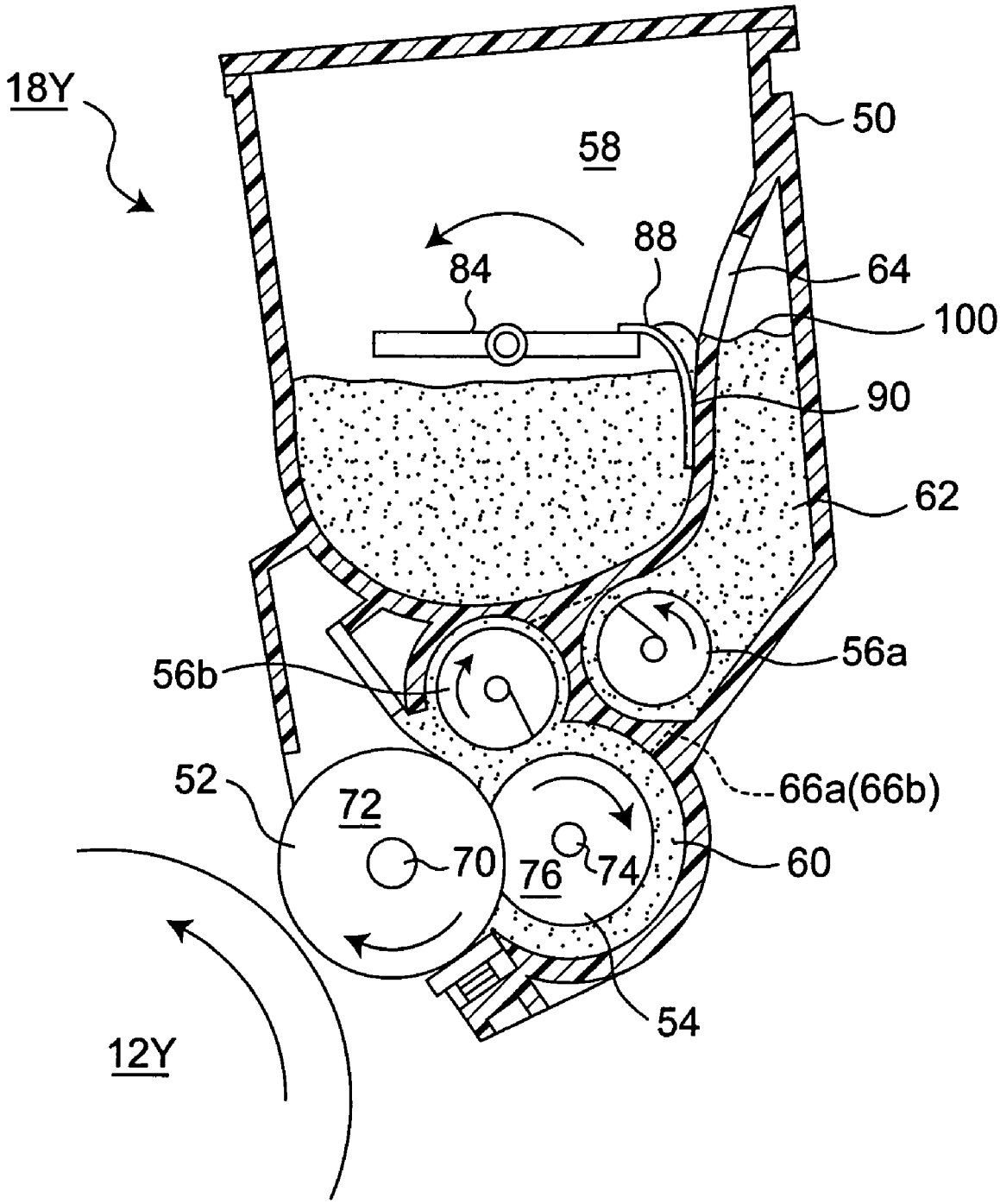
FIG. 2 is a cross sectional view of a developing device according to a first embodiment of the present invention, taken along II-II lines in FIG. 3.

Discussions will be made to the developing device. FIG. 2 shows an elevational cross-sectional view of the developing device 18Y in a place perpendicular to the rotational axis of the drum. Other developing devices 18M, 18C, and 18K have the same or substantially the same structure as the developing device 18Y.

As indicated in the drawing, the developing device 18Y has a housing 50. The housing 50 includes a developing material bearing member or developing roller 52 for developing the electrostatic latent image with toner 100 accommodated within the housing 50, a feed roller 54 for feeding toner to the developing roller 52, and two conveyors or screws 56*a* and 56*b* for conveying toner in opposite directions parallel to or substantially parallel to the central axis of the drum. The toner 100 is made of significantly small particles so that, when mixed with air, it has certain liquidity, namely, it acts as powder and granular material capable of flowing like liquid.

Figure 3:
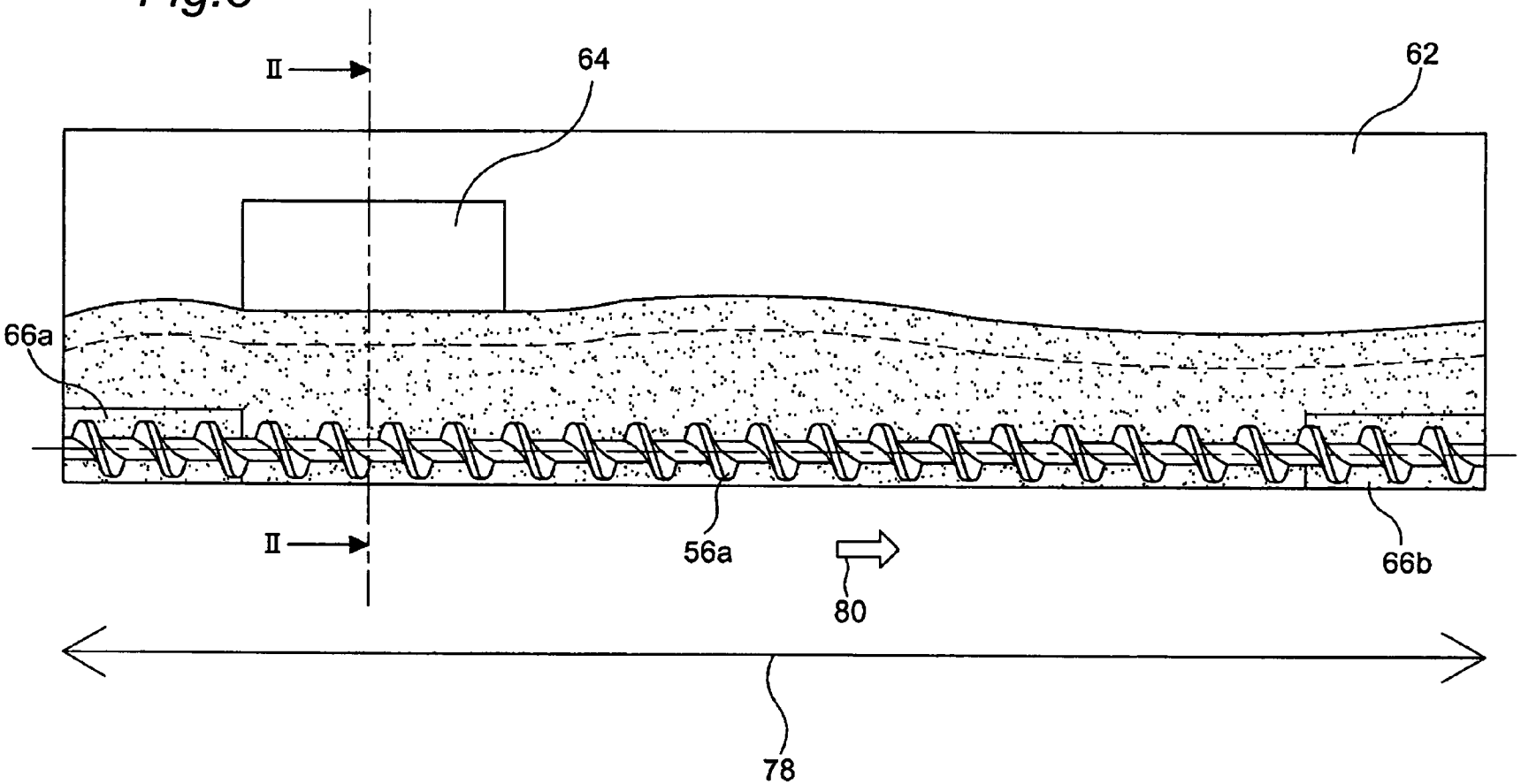
FIG. 3 is a side elevational view showing a structure of a buffer chamber.

The interior of the housing 50 for receiving toner is generally divided into three chambers, i.e., a storing chamber 58 for storing toner, a waiting chamber 60 for storing toner before it is supplied to the developing roller 52 for the image formation, and a buffer chamber 62 for temporarily storing toner being transported from the storing chamber 58 to the waiting chamber 60. The storing chamber 58 is connected to the buffer chamber 62 through a connecting path 64 (see FIG. 3). The buffer chamber 62 is connected to the waiting chamber 60 through two connecting paths 66*a* and 66*b* (see FIG. 3). As shown in FIG. 3, the connecting paths 66*a* and 66*b* are preferably provided on opposite ends of the buffer chamber 62 and the waiting chamber 60.

The developing roller 52, made of a cylindrical metal core 70 and an elastic layer 72 formed around the outer peripheral surface of the metal core 70, is mounted for rotation about an axis extending parallel to that of the drum and the peripheral surface thereof is in part projected from the housing 50. The projected peripheral surface portion of the developing roller 52 faces the outer peripheral surface of the drum to form a developing region therewith. This allows that in developing operation the developing roller 52 bears toner on its outer peripheral surface and rotates through the developing region where the toner is electrostatistically supplied to the outer periphery of the drum for developing. Preferably, a voltage is applied from an voltage application means (not shown) between the drum and the developing roller 52 to form an electric field between the opposed outer peripheral surfaces of the drum and the developing roller, allowing the toner to be electrostatistically transferred from the developing roller 52 to the drum.

The feed roller 54, made of a cylindrical metal core 76 and a foamed elastic layer 76 mounted around the outer peripheral surface of the metal core 74, is supported for rotation about its axis extending parallel to the developing roller 52 and is mounted within the waiting chamber 60 with its outer peripheral surface in contact with the outer periphery of the developing roller 52. This allows that in developing operation the feed roller 54 bears toner on its peripheral surface and rotates through the contact region with the developing roller 52 where the toner is supplied onto the developing roller 52.

Figure 4:
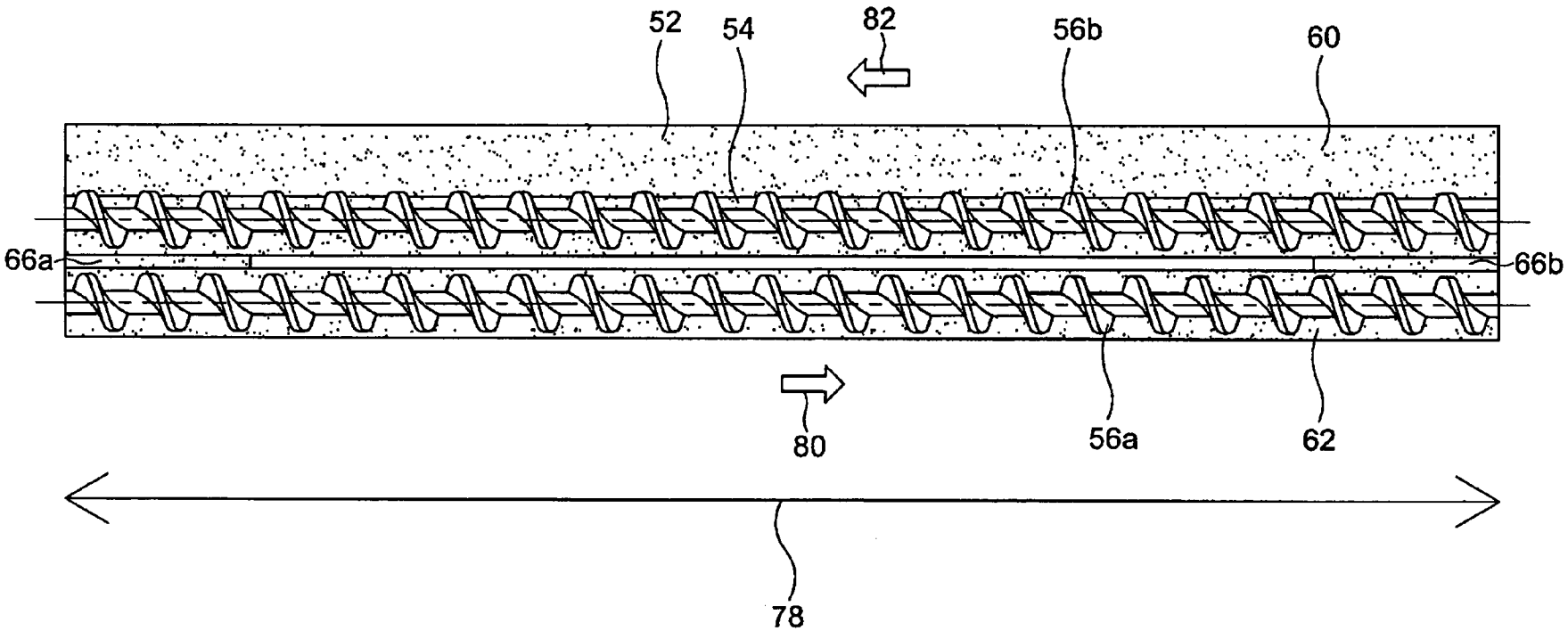
FIG. 4 is a plan view showing two screws mounted in the buffer and waiting chambers, respectively.

As shown in FIG. 4, the screws 56*a* and 56*b* are supported for rotation by the housing 50 with their rotational axes positioned in parallel to each other for conveying toner in opposite directions parallel to the direction along which the rotational axis 78 of the drum extends. As best shown in FIG. 2, the screw 56*a* is disposed within the buffer chamber 62 adjacent and behind the openings of the connecting paths 66*a* and 66*b*. The screw 56*b* is disposed within the waiting chamber 60 adjacent and in front of the openings of the connecting paths 66*a* and 66*b* and above the contact region between the developing roller 52 and the feed roller 54.

As best shown in FIG. 4, in operation the screws 56*a* and 56*b* are rotated in respective directions to convey toner in different direction. In particular, the toner is conveyed in the direction 80 by the screw 56*a* and in the opposite direction 82 by the screw 67*b*, causing the toner to be circulated through the buffer chamber 62, connecting path 66*b*, waiting chamber 60 and connecting path 66*a*.

Figure 5:
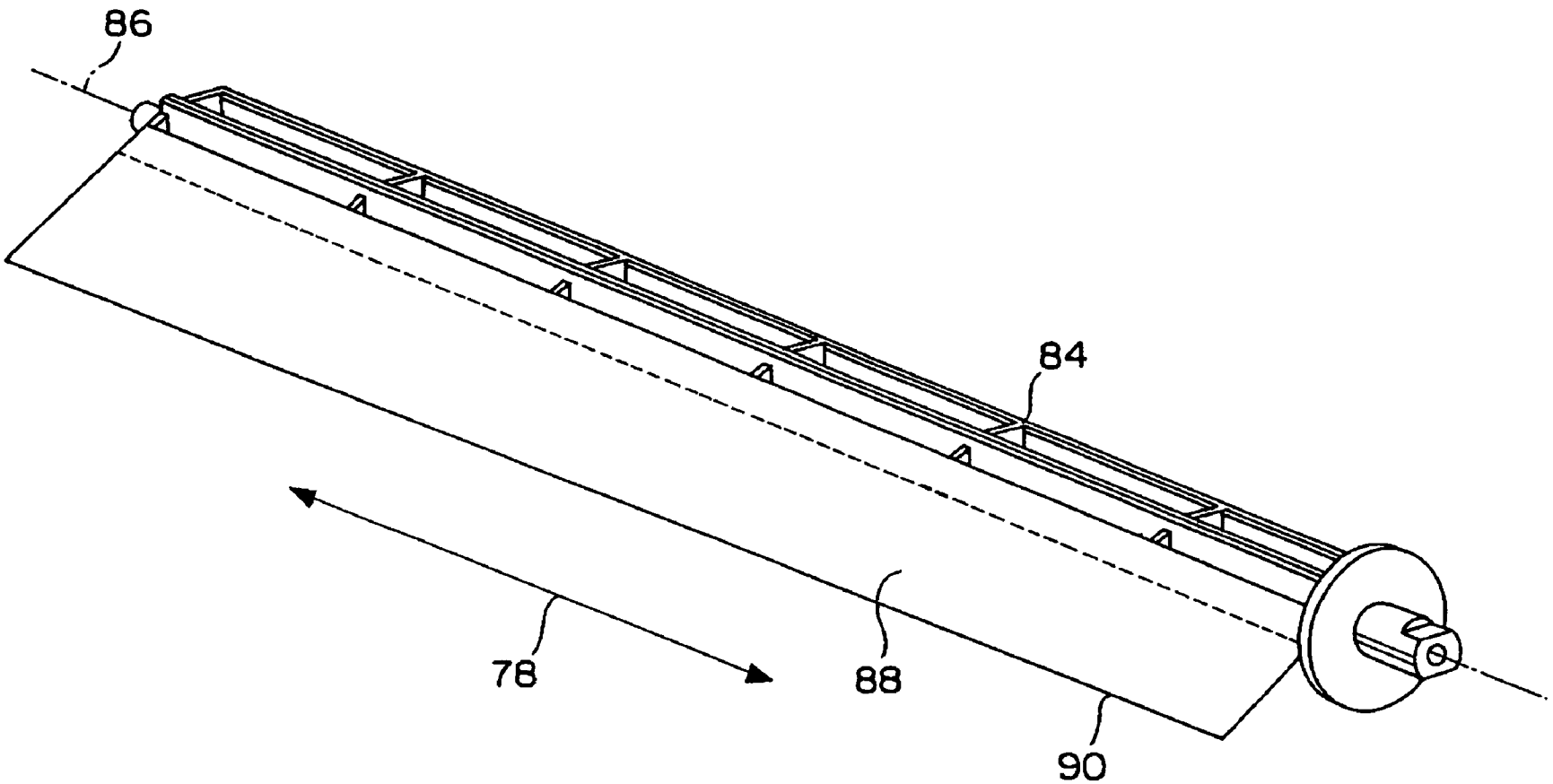
FIG. 5 is a perspective view showing a mixing member provided in the storing chamber.

As shown in FIG. 2, the storing chamber 58 for storing toner is located above within the housing 50 and is communicated through a connecting path 64 extending horizontally (see FIG. 3) and provided at an upper wall portion defining in part the storing chamber 58. Provided within the storing chamber 58 is a mixing member 84 for mixing the toner with air. As shown in FIG. 5, the mixing member 84 has an elongated frame structure having a rotational axis 86 extending in the direction 78 parallel to the rotational axis of the drum. The mixing member 84 supports a flexible paddle 88 for feeding the mixed toner into the buffer chamber 62 through the connecting path 64.

The flexible paddle 88 is in the form of sheet extending in the direction parallel to the rotational axis 78 of the drum and is so disposed as to extend radially from the central axis 86 of the mixing member 84 to reach the bottom surface of the storing chamber 58 as shown in FIG. 2. This allows that with the rotation of the mixing member 84 the flexible paddle 88, in particular the distal end 90 of the flexible paddle 88 brings into sweeping contact with the bottom surface of the storing chamber 58 to move the mixed toner in the rotational direction. Then, the flexible paddle 88 reaching adjacent the connecting path 64 feeds the mixed toner into the buffer chamber 62 through the connecting path 64.

The waiting chamber 60, for receiving toner which would be fed into the waiting chamber 60 afterwards, accommodates the feed roller 54 disposed at the lower portion of the housing 50. The waiting chamber 60 is connected through the horizontally extended connecting paths 66*a* and 66*b* to the lower portions of the buffer chamber 62. As shown in FIG. 2, the waiting chamber 60 is defined by portions of the housing 50 and a part of the developing roller 52. Preferably, the gaps between developing roller 52 and the opposed portions of the housing 50 are sealed by a suitable sealing member to prevent any possible leakage of toner from the waiting chamber 60 into the air. The sealing material is preferably made of material which would not prevent the stable rotation of the developing roller 52.

The volume of the waiting chamber 60 is designed so as to accommodate a certain amount of toner necessary for the formation of the images without any image defect. Specifically, in order to make high quality image the developing roller 52 is required to bear a certain amount of toner necessary for the formation of images. This is attained by the fact that the certain amount of toner more than the requirement is accommodated within the waiting chamber and then it is fed by the feed roller 54 from the waiting chamber 60 to the developing roller 52.

The buffer chamber 62 connecting between the storing chamber 58 and the waiting chamber 60 is to temporally accommodate toner being fed from the storing chamber 58 to the waiting chamber 60 and to ensure that the waiting chamber 60 is stably filled with toner.

The connecting path 64 extends substantially horizontally to connect between the upper portion of the storing chamber 58 and the upper portion of the buffer chamber 62. As shown in FIG. 3, the opening of the connecting path 64 adjacent the buffer chamber 62 is positioned on the upstream side of the toner conveying direction 80 in the buffer chamber 62.

As shown in FIG. 4, the connecting paths 66*a* and 66*b* each extend substantially horizontally to connect between the upper portion of the waiting chamber 69 and the lower portion of the buffer chamber 62, ensuring the circulation of the toner between the waiting chamber 60 and the buffer chamber 62 by two screws 56*a* and 56*b*. For example, the opening of the connecting path 66*a* adjacent the waiting chamber 60 is positioned to oppose the downstream end with respect to the toner conveying direction 82 and the other opening of the connecting path 66*a* adjacent the buffer chamber 62 is positioned to oppose the upstream end with respect to the other toner conveying direction 80. Also, the opening of the connecting path 66*b* adjacent the waiting chamber 60 is positioned to oppose the upstream end with respect to the toner conveying direction 82 and the other opening of the connecting path 66*b* adjacent the buffer chamber 62 is positioned to oppose the downstream end with respect to the other toner conveying direction 80.

The foregoing has described the components of the developing device. Those components cooperate with each other to ensure a stable development of the electrostatic latent image on the drum, i.e., to ensure that the developing roller 54 bears the necessary amount of toner hereon, even if the image forming apparatus 10 is installed tilted.

In the developing operation of the developing device, as shown in FIG. 2 the developing roller 52, the feed roller 54, the screws 56*a* and 56*b* and the mixing member 84 are rotated at predetermined respective speeds by the dive means such as a motor.

The rotation of the mixing member 84 causes toner in the storing chamber 58 to be fed into the buffer chamber 60 through the connecting path 64. The toner fed from the storing chamber 58 into the buffer chamber 62 is conveyed in the direction 80 and also the toner in the buffer chamber 62 is supplied through the connecting path 66*a* into the waiting chamber 60. The excessive toner in the waiting chamber 60 is returned through the 66*b* into the buffer chamber 62. This allows that the toner is circulated between the waiting chamber 60 and the buffer chamber 62 through the connecting paths 66*a* and 66*b*. This ensures that the waiting chamber 60 stably holds the certain amount of toner while maintaining its variation as small as possible. In particular, as shown in FIG. 4 even if an excessive amount of toner is fed from the buffer chamber 66 into the waiting chamber 60 through the connecting path 66*b*, substantially the same amount of toner is returned from the from the waiting chamber 60 into the buffer chamber 62 through the other connecting path 66*a* and thereby the variation of the toner amount within the waiting chamber 60 is minimized, which maintaining the amount of toner within the waiting chamber 60 substantially constant.

Initially, the storing chamber 58 and the buffer chamber 62 hold respective amounts of toner so that the top surfaces thereof in the chambers stay substantially at the lower edge of the opening of the connecting path 64. Also, the waiting chamber 60 is filled with toner.

The toner in the waiting chamber is fed to the developing roller 52 by the feed roller 54 and then consumed for the development of the electrostatic latent image on the drum. The decrease of the toner is compensated with toner fed from the buffer chamber 62, which maintains the condition that the waiting chamber 60 is filled with toner. Also, the decrease of the toner in the buffer chamber 62 is compensated with toner which is lifted up in the storing chamber 58 by the sweeping movement of the flexible paddle 88 into the connecting path 64. A part of the toner fed from the storing chamber 58 into the buffer chamber 62 flows out through the connecting path 64 back into the storing chamber 58 due to its fluidity. This ensures that, even if the toner is fed from the storing chamber 58 into the buffer chamber 62 regularly irrespective of whether the toner has been conveyed from the buffer chamber 62 into the waiting chamber 60, the excessive toner in the buffer chamber 62 returns back into the storing chamber 58, so that the level of the toner in the buffer chamber 62 is kept substantially constant at adjacent the lower edge of the connecting path 64 due to the existence of the horizontally extending connecting path 64.

As described above, the waiting chamber 60 is maintained that it is filled with toner and the amount of toner within the chamber 60 is kept constant, which maintains the toner pressure within the chamber 60 substantially constant. The pressure is caused by the weight of toner in the buffer chamber 62. Also, the toner pressure varies with a density of toner. This means that a higher density causes a high toner pressure and, on the contrary, a lower density leads a lower toner pressure.

An excessively high toner pressure in the waiting chamber 60 can deteriorate a stable rotation of the feed roller 54 within the waiting chamber 60 or can halt the rotation thereof. Therefore, it is necessary for the toner pressure in the waiting chamber 60 to be suitably kept constant. For this purpose, the level and/or the horizontal length of the lower edge of the connecting path 64 at the entrance of the buffer chamber 62 is so determined that it ensures a suitable amount to toner to be accommodated within the buffer chamber 62.

With the repetition of the image formations, the amount of toner in the storing chamber 58 decreases. This results in the decrease in the amount of toner from the storing chamber 58 into the buffer chamber 62 by each lifting of the flexible paddle 88. After the toner in the storing chamber 58 is completely consumed, the amount of toner in the buffer chamber 62 decreases gradually with the repetitions of image formations, which in turn results in the gradual decrease of toner pressure within the waiting chamber 60. The pressure decrease may be detected by a suitable pressure sensor or level sensor provided in the waiting chamber 60. Finally, when all the toner within the buffer chamber 62 is consumed, further developing operation by the developing device is prohibited.

Ideally, the image forming apparatus 10 is preferably installed without any tilt so that the rotational axes of the drum and developing roller are kept horizontally, however, not all the image forming apparatus can be mounted without tilt. The tilting of the central axes of the drum and the developing roller causes the toner in the storing chamber 58 and the buffer chamber 62 flows toward one side of the axes.

Figure 6A:
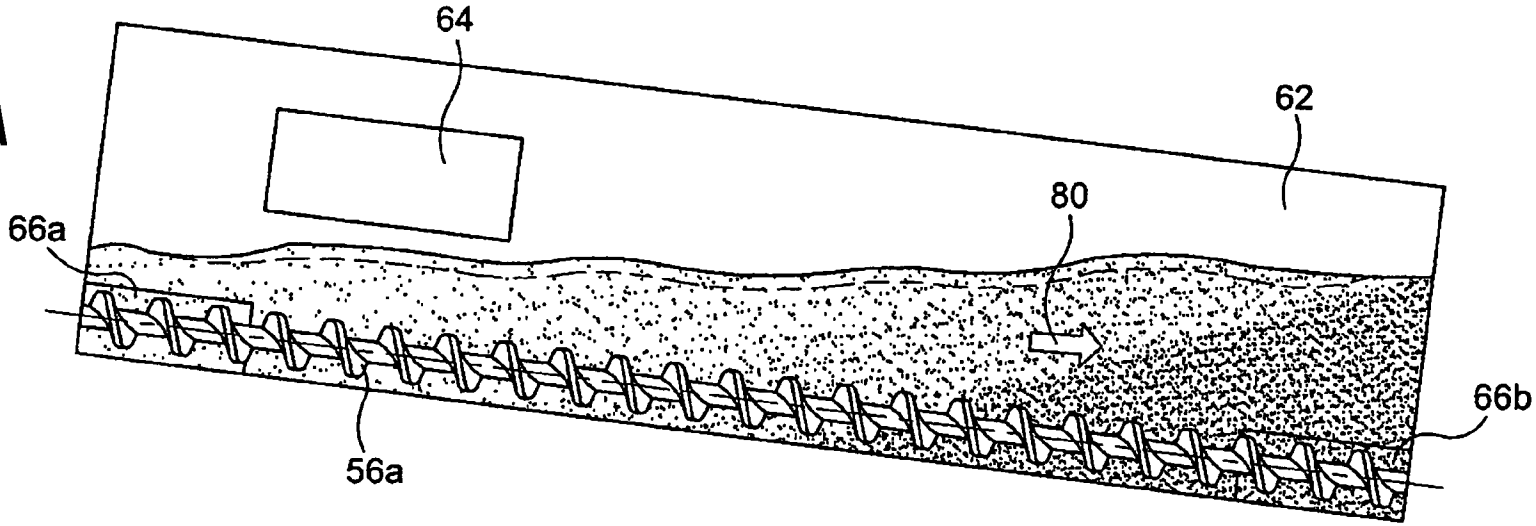
FIGS. 6A and 6B are side elevational views showing inclined buffer chambers.

In particular, FIG. 6A shows that the image forming apparatus as well as its buffer chamber 62 is so tilted that the connecting path 66*a* takes a higher position than the other connecting path 66*b*. In this condition, the toner in the buffer chamber 62 and the storing chamber 58 tend to move toward one side adjacent the lower connecting path 66*b* due to the gravity. Also, the depth of toner adjacent the connecting path 64 in the storing chamber is decreased, which may result in the decrease of the amount of toner fed from the storing chamber 58 into the buffer chamber 62 by each lifting of the flexible paddle 88. This may cause a decrease in the amount of toner within the buffer chamber 62. However, as indicated in FIG. 6A, the toner adjacent the connecting path 66*b* has a higher density than that adjacent the other connecting path 66*a*. Therefore, the decrease in amount of toner in the buffer chamber 62 is compensated by the increase of the toner density. This ensures that substantially the same amount of toner is fed into the waiting chamber 60, so that the toner pressure in the waiting chamber 60 is kept constant. Then, even if the image forming apparatus is disadvantageously tilted, the image forming apparatus of the present invention is ensured to produce images without any defects.

Figure 6B:
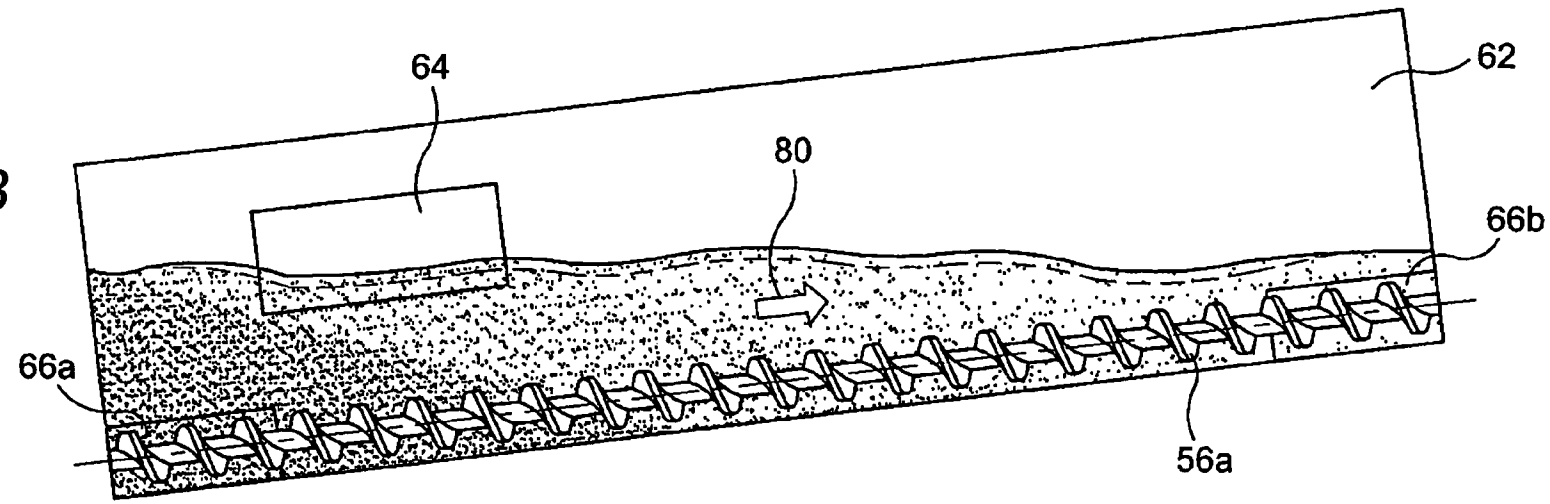

FIG. 6B shows that the image forming apparatus as well as its buffer chamber 62 is so tilted that the other connecting path 66*b* takes a higher position than the connecting path 66*a*. In this condition, the amount of toner adjacent the connecting path 64 in the storing chamber 58 is increased, so that the amount of toner to be fed by each lifting by the flexible paddle 88 is increased. This may results in an increase of the total amount of toner within the buffer chamber 60. However, the density of toner adjacent the connecting path 66*b* is decreased, so that the low density toner is fed into the waiting chamber 60 through the connecting path 66*b*. Therefore, the increase in amount of toner in the buffer chamber 62 is cancelled by the decrease of the toner density. This ensures that substantially the same amount of toner is fed into the waiting chamber 60, so that the toner pressure in the waiting chamber 60 is kept constant. Then, even if the image forming apparatus is disadvantageously tilted, the image forming apparatus of the present invention is ensured to produce images without any defects.

As described above, according to the image forming apparatus, the mechanism for ensuring substantially the same amount of toner to be accommodated within the waiting chamber 60 even in the tilted condition is attained by the fact that the waiting chamber 60 is filled with toner. This in turn is attained by the design in which the buffer chamber 62 is formed between the storing chamber 58 and the waiting chamber 60 and the connecting path 64 is connected to the buffer chamber 62 on its upstream side with respect to the toner conveying direction 80.

To prove this, assume that the connecting path 66*a* takes a higher position than the other connecting path 66*b*. Also assumed is that the connecting path 64 is formed at the center or adjacent the connecting path 66*b*, rather than adjacent the connecting path 66*a*, i.e., on the downstream side with respect to the toner transporting direction 80. Under the condition, a greater amount of toner is fed from the storing chamber 58 through the connecting path 64 into the buffer chamber 62. This results in that the toner adjacent the 66*b* has an excessively high density. The high density toner causes an excessive amount of toner to be filled in the waiting chamber 50.

Next assumed that the connecting path 66*b* takes a higher position than the other connecting path 66*a*. Also assumed is that the connecting path 64 is formed at the center or adjacent the connecting path 66*a*, rather than adjacent the connecting path 66*b*, i.e., on the downstream side with respect to the toner transporting direction 80. Under the condition, a smaller amount of toner is fed from the storing chamber 58 through the connecting path 64 into the buffer chamber 62. This results in that the toner adjacent the 66*b* has an excessively low density. The less density toner causes an insufficient amount of toner to be filled in the waiting chamber 50.

Second Embodiment

Figure 7:
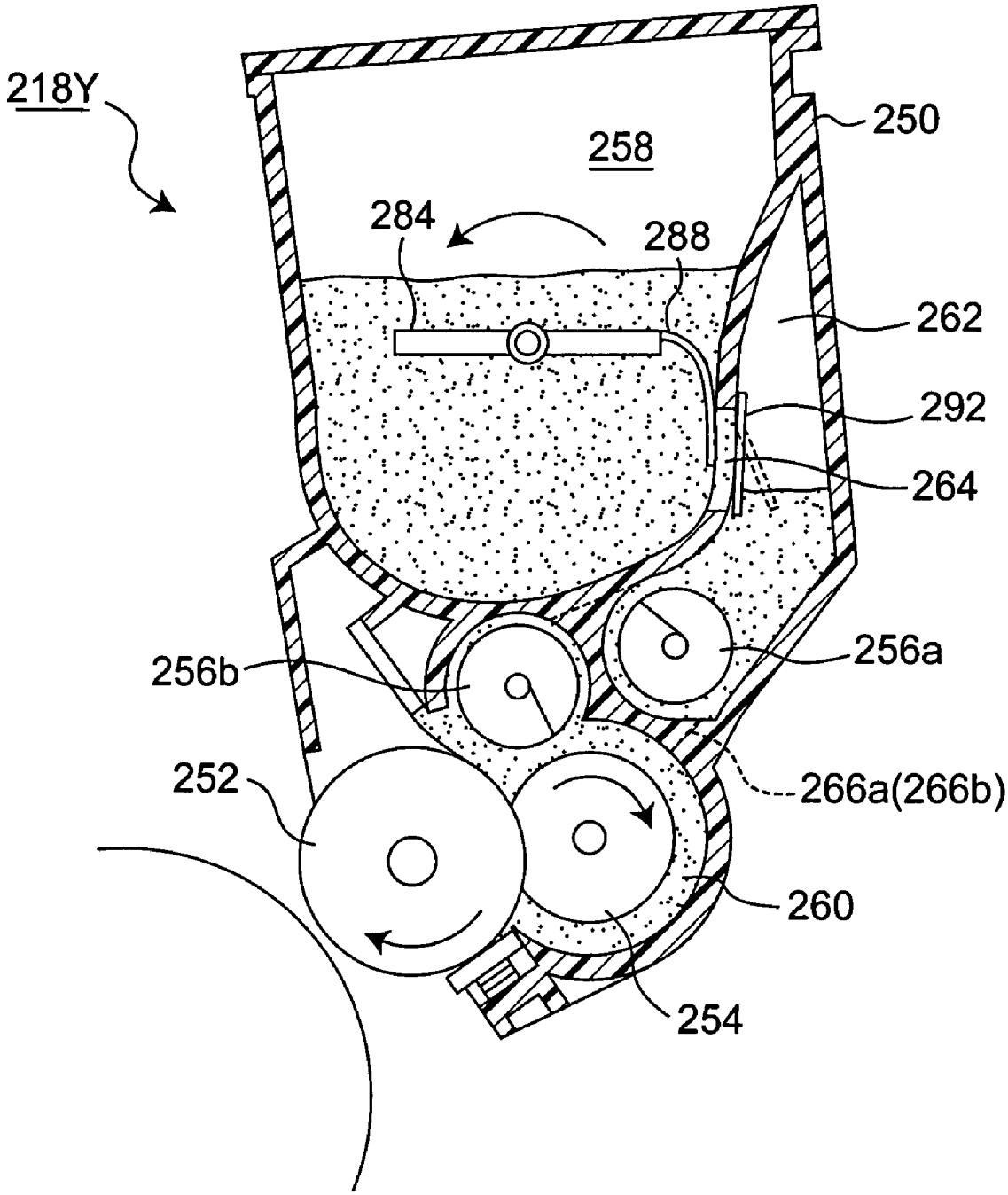
FIG. 7 is a cross sectional view of the developing device according to the second embodiment according to the present invention.

FIG. 7 shows a second embodiment of the developing device according to the present invention in which parts and members similar to those indicated in FIG. 2 are indicated by reference numerals each increased by "200". As indicated in the drawing, the connecting path 264 connects the lower portion of the storing chamber 258 and the upper portion of the buffer chamber 262. Similar to the first embodiment, the connecting path 264 is provided on the upstream side of the buffer chamber 262 with respect to the toner conveying direction.

In particular, the opening of the connecting path 264 adjacent the buffer chamber 262 is covered by a toner restriction member for restricting the toner flow from the buffer chamber 262 back into the storing chamber 258. For example, the restriction member has a valve 292 made of flexible sheet which is so sized to cover the entire opening of the connecting path 264. The valve 292 is bonded at its top to a portion of housing 250 above the opening so that it completely closes the connecting path 264 even when no toner exists behind the valve 292 within the buffer chamber 262. This allows that normally the valve 292 takes the closed position indicated by the solid lines and prevents toner in the buffer chamber 262 from flowing back into the storing chamber 258, but it takes the curved opened position indicated by the dotted lines when toner is forcedly moved by the paddle 288 from the storing chamber 264 into the connecting path 264 into the buffer chamber 262.

In particular, the buffer chamber 262 stores toner forcedly fed by the paddle 288 and flown in by gravity from the storing chamber 258 through the connecting path 264. Once the level of the toner stored within the buffer chamber 262 reaches the opening of the connecting path 264, the valve 292 begins to receive a back pressure from the toner within the buffer chamber 262 so that it is forced against the wall to close the connecting path. The closed position is maintained as long as the passive pressure from the buffer chamber 262 overcomes the active pressure from the storing chamber 258, preventing an excessive toner from being fed from the storing chamber 258 into the buffer chamber 262.

The closed position will be broken when the top surface of toner in the buffer chamber 262 is lowered to a certain level where the active pressure from the storing chamber 258 overcomes the passive pressure from the buffer chamber 262. When the active pressure from the storing chamber 258 overcomes the passive pressure from the buffer chamber 262, the valve 292 is forced away from the wall to open the connecting path 264. As described above, the valve 292 moves between the closed position and the opened position according to the level or the amount of toner stored within the buffer chamber 262, thereby maintaining the amount of toner within the buffer chamber substantially constant.

Also, according to the developing device, the connecting path is positioned lower than that in the first embodiment, which minimizes the amount of unused toner which would remain in the storing chamber.

Variations

The foregoing description of the invention is merely exemplary in nature and, thus, variations that do not depart from the gist of the invention are intended to be within the scope of the invention. Such variations are not to be regarded as a departure from the spirit and scope of the invention.

Figure 8:
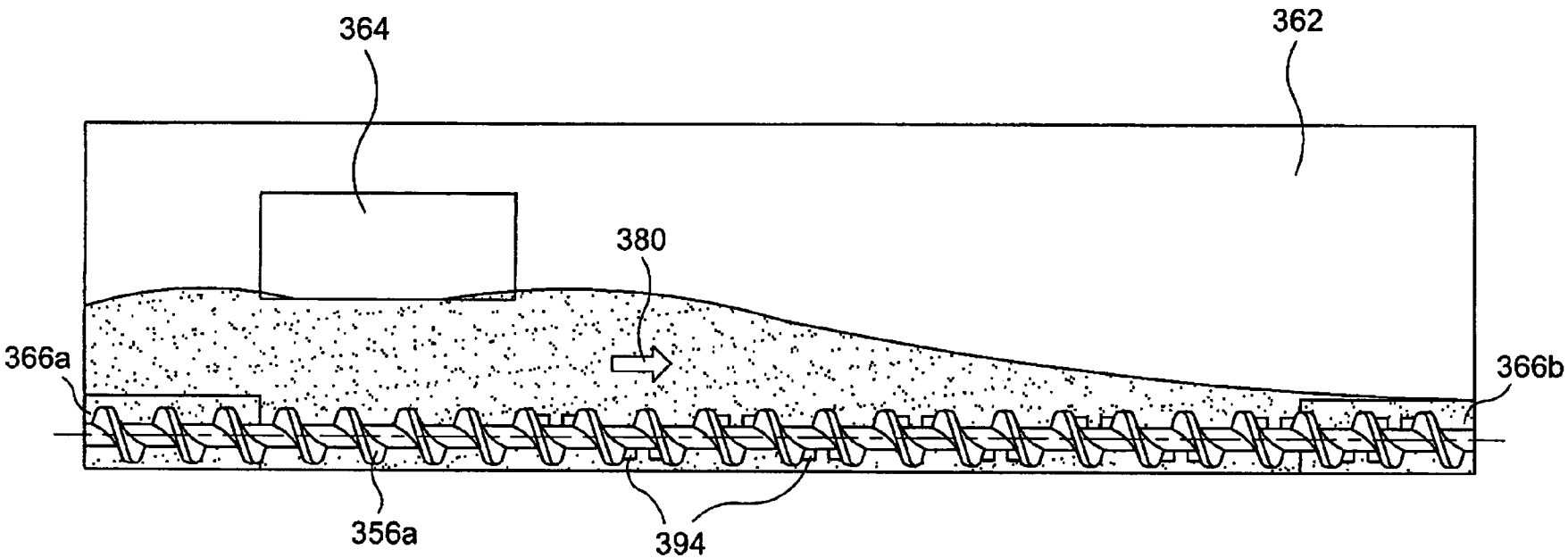
FIG. 8 is a side elevational view showing a modified screw.

For example, as shown in FIG. 8 the screw 356*a* may have paddles 394 each provided between neighboring blades and extending radially outwardly. Preferably, the paddles 394 are provided on the downstream side of the screw 356*a* with respect to the toner conveying direction. This arrangement allows that the toner level on the upstream side is maintained higher than that on the downstream side. This is because that the existence of the paddles 394 reduces the conveying ability of the portions of the screw 356*a* adjacent the paddles 394, i.e., the downstream side portions of the screw. As a result, even a smaller amount of toner allows the toner in the buffer chamber 362 to flow back into the storing chamber and thereby maintains the amount of toner within the buffer chamber 362 substantially constant.

Figure 9:
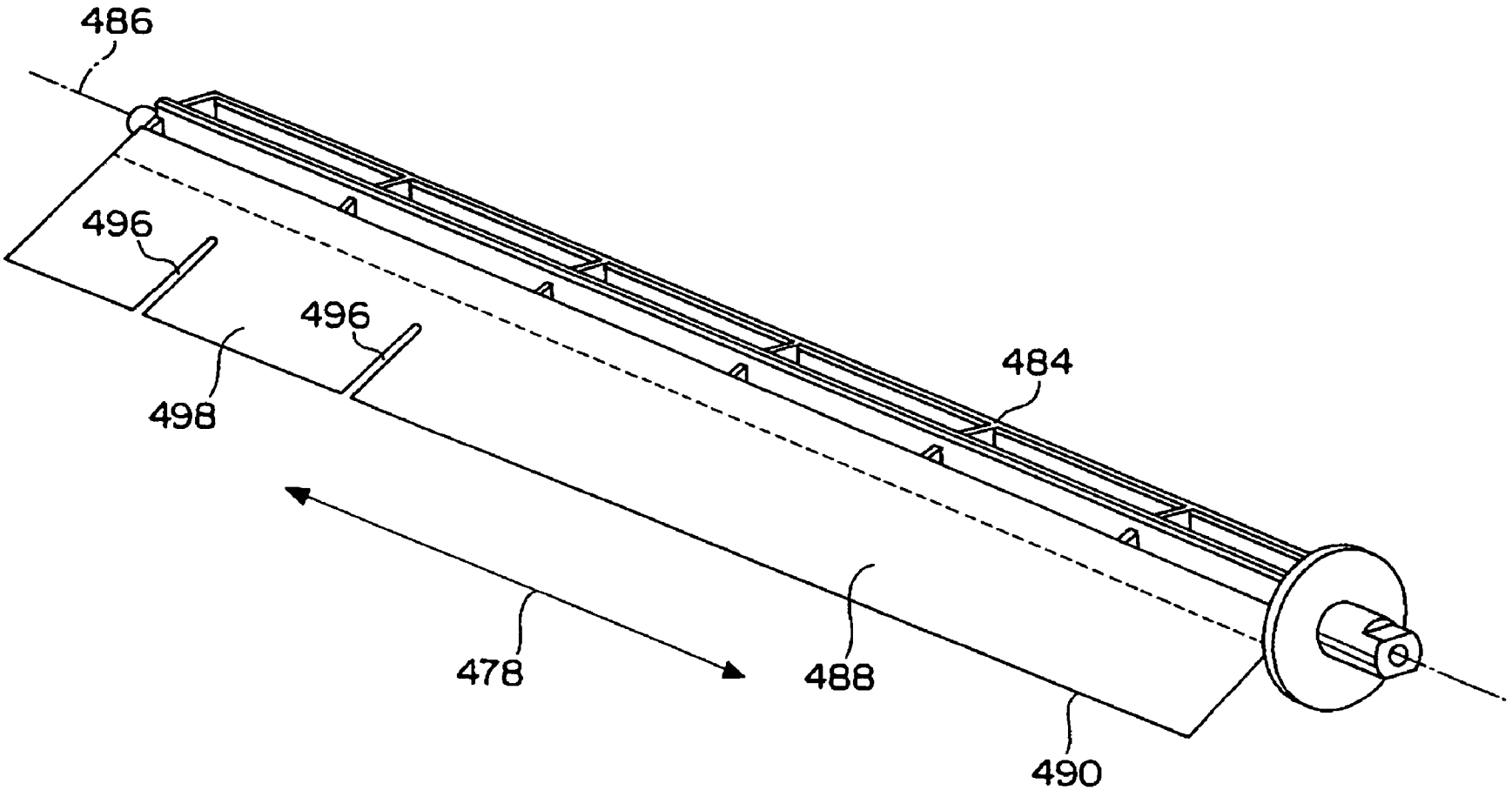
FIG. 9 is a perspective view showing a modified mixing member.

As shown in FIG. 9, the paddle 490 may have a pair of parallel cuts 496 each extending inwardly, i.e., perpendicular to the axis of the mixing member, to a certain extent from the longitudinal outermost edge of the paddle to form a sub-paddle 498 therebetween. The sub-paddle 498 has a certain width in the direction 478 which is smaller than the corresponding width of the connecting path between the storing chamber and the buffer chamber and is so positioned that when the mixing member is installed in the storing chamber the sub-paddle opposes the connecting path. This arrangement allows that the sub-paddle 498 makes intermittent contacts with the valve through the connecting path to move the valve into the opened position during the rotation of the mixing member.

Further, although the top surface of toner in the buffer chamber is so maintained that it stays substantially at the same level as the lower edge of the connecting path, the developing device may be designed so that it stays higher than the lower edge of the connecting path. In this arrangement, the volume of the buffer chamber and the size, shape, and the position of the connecting path of the developing device are preferably determined so as not to apply an excessive pressure on the feed roller in the waiting chamber which would prevent the stable rotation thereof.

What is claimed is:

1. A developing device having a bearing member capable of bearing a developer material for developing an electrostatic latent image using the developer material, comprising:

a bearing member capable of bearing a developer material thereon;

a storing chamber capable of storing the developer material;

a waiting chamber disposed below the storing chamber, the waiting chamber receiving the bearing member and being capable of being fully or substantially fully filled with the developer material;

a buffer chamber positioned between the storing chamber and the waiting chamber, the buffer chamber being capable of storing the developer material fed from the storing chamber and to be fed into the waiting chamber;

a first connecting path extending horizontally and connecting an upper portions of the storing and buffer chambers;

two second connecting paths each connecting a lower portion of the buffer chamber and the waiting chamber;

a feed member capable of feeding the developer material from the storing chamber through the first connecting path into the buffer chamber;

a first conveying member disposed within the buffer chamber, the first conveying member being capable of conveying the developer material within the buffer chamber in a first direction from one of the two connecting paths to the other of the two connecting paths; and a second conveying member disposed within the waiting chamber, the second conveying member being capable of conveying the developer material within the waiting chamber in a second direction from the other of the two connecting paths to the one of the two connecting paths;

wherein the first connecting path is provided on an upstream side with respect to the first conveying direction.

2. The developing device of claim 1, wherein the first and second conveying members are disposed parallel to the bearing member.

3. The developing device of claim 1, wherein the two second connecting paths are provided to connect opposite ends of the buffer chamber and the waiting chamber.

4. The developing device of claim 1, wherein the first conveying member is so disposed that the developing material fed from the first connecting path is conveyed by the first conveying member and then through the other of the two second connecting paths into the waiting chamber.

5. The developing device of claim 1, wherein the first toner conveying member has first and second portions provided on upstream and downstream sides with respect to the first direction, the first portion having a greater developer material conveying ability with respect to the first direction than the second portion.

6. A developing device having a bearing member capable of bearing a developer material for developing an electrostatic latent image using the developer material, comprising:

a bearing member capable of bearing a developer material thereon;

a storing chamber capable of storing the developer material;

a waiting chamber disposed below the storing chamber, the waiting chamber receiving the bearing member and being capable of being fully or substantially fully filled with the developer material;

a buffer chamber positioned between the storing chamber and the waiting chamber, the buffer chamber being capable of storing the developer material fed from the storing chamber and to be fed into the waiting chamber;

a first connecting path extending horizontally and connecting a lower portion of the storing chamber and an upper portion of the buffer chambers;

two second connecting paths each connecting a lower portion of the buffer chamber and the waiting chamber;

a feed member capable of feeding the developer material from the storing chamber through the first connecting path into the buffer chamber;

a first conveying member disposed within the buffer chamber, the first conveying member being capable of conveying the developer material within the buffer chamber in a first direction from one of the two connecting paths to the other of the two connecting paths;

a second conveying member disposed within the waiting chamber, the second conveying member being capable of conveying the developer material within the waiting chamber in a second direction from the other of the two connecting paths to the one of the two connecting paths; and a restriction member capable of restricting a feeding of the developer material from the storing chamber into the buffer chamber;

wherein the first connecting path is provided on an upstream side with respect to the first conveying direction.

7. The developing device of claim 6, wherein the first and second conveying members are disposed parallel to the image bearing member.

8. The developing device of claim 6, wherein the two second connecting paths are provided to connect opposite ends of the buffer chamber and the waiting chamber.

9. The developing device of claim 6, wherein the first conveying member is so disposed that the developing material fed from the first connecting path is conveyed by the first conveying member and then through the other of the two second connecting paths into the waiting chamber.

10. The developing device of claim 6, wherein the first toner conveying member has first and second portions provided on upstream and downstream sides with respect to the first direction, the first portion having a greater developer material conveying ability with respect to the first direction than the second portion.

11. An electrophotographic image forming apparatus, comprising:

an electrostatic latent image bearing member capable of bearing an electrostatic latent image thereon; and a developing device having a bearing member capable of bearing a developer material for developing the electrostatic latent image using the developer material;

the developing device further including a bearing member capable of bearing a developer material thereon, the bearing member being disposed parallel to the electrostatic latent image bearing member;

a storing chamber capable of storing the developer material;

a waiting chamber disposed below the storing chamber, the waiting chamber receiving the bearing member and being capable of being fully or substantially fully filled with the developer material;

a buffer chamber positioned between the storing chamber and the waiting chamber, the buffer chamber being capable of storing the developer material fed from the storing chamber and to be fed into the waiting chamber;

a first connecting path extending horizontally and connecting an upper portions of the storing and buffer chambers;

two second connecting paths each connecting a lower portion of the buffer chamber and the waiting chamber;

a feed member capable of feeding the developer material from the storing chamber through the first connecting path into the buffer chamber;

a first conveying member disposed within the buffer chamber, the first conveying member being capable of conveying the developer material within the buffer chamber in a first direction from one of the two connecting paths to the other of the two connecting paths; and a second conveying member disposed within the waiting chamber, the second conveying member being capable of conveying the developer material within the waiting chamber in a second direction from the other of the two connecting paths to the one of the two connecting paths;

wherein the first connecting path is provided on an upstream side with respect to the first conveying direction.

12. The developing device of claim 11, wherein the first and second conveying members are disposed parallel to the image bearing member.

13. The developing device of claim 11, wherein the two second connecting paths are provided to connect opposite ends of the buffer chamber and the waiting chamber.

14. The developing device of claim 11, wherein the first conveying member is so disposed that the developing material fed from the first connecting path is conveyed by the first conveying member and then through the other of the two second connecting paths into the waiting chamber.

15. The image forming apparatus of claim 11, wherein the first toner conveying member has first and second portions provided on upstream and downstream sides with respect to the first direction, the first portion having a greater developer material conveying ability with respect to the first direction than the second portion.

16. An electrophotographic image forming apparatus, comprising:

an electrostatic latent image bearing member capable of bearing an electrostatic latent image thereon; and a developing device having a bearing member capable of bearing a developer material for developing the electrostatic latent image using the developer material;

the developing device further including a bearing member capable of bearing a developer material thereon, the bearing member being disposed parallel to the electrostatic latent image bearing member;

a storing chamber capable of storing the developer material;

a waiting chamber disposed below the storing chamber, the waiting chamber receiving the bearing member and being capable of being fully or substantially fully filled with the developer material;

a buffer chamber positioned between the storing chamber and the waiting chamber, the buffer chamber being capable of storing the developer material fed from the storing chamber and to be fed into the waiting chamber;

a first connecting path extending horizontally and connecting a lower portion of the storing chamber and an upper portion of the buffer chambers;

two second connecting paths each connecting a lower portion of the buffer chamber and the waiting chamber;

a feed member capable of feeding the developer material from the storing chamber through the first connecting path into the buffer chamber;

a first conveying member disposed within the buffer chamber, the first conveying member being capable of conveying the developer material within the buffer chamber in a first direction from one of the two connecting paths to the other of the two connecting paths;

a second conveying member disposed within the waiting chamber, the second conveying member being capable of conveying the developer material within the waiting chamber in a second direction from the other of the two connecting paths to the one of the two connecting paths; and a restriction member capable of restricting a feeding of the developer material from the storing chamber into the buffer chamber;

wherein the first connecting path is provided on an upstream side with respect to the first conveying direction.

17. The developing device of claim 16, wherein the first and second conveying members are disposed parallel to the image bearing member.

18. The developing device of claim 16, wherein the two second connecting paths are provided to connect opposite ends of the buffer chamber and the waiting chamber.

19. The developing device of claim 16, wherein the first conveying member is so disposed that the developing material fed from the first connecting path is conveyed by the first conveying member and then through the other of the two second connecting paths into the waiting chamber.

20. The image forming apparatus of claim 16, wherein the first toner conveying member has first and second portions provided on upstream and downstream sides with respect to the first direction, the first portion having a greater developer material conveying ability with respect to the first direction than the second portion.

* * * * *